US006100802A

United States Patent [19]

Adams

[11] Patent Number: 6,100,802

[45] Date of Patent: Aug. 8, 2000

[54] ALARMED CABLE LOCK

[75] Inventor: Morgan Allen Adams, Phoenix, Ariz.

[73] Assignee: Nitro Security Systems, L.L.C., Phoenix, Ariz.

[21] Appl. No.: 09/195,191

[22] Filed: Nov. 16, 1998

[51] Int. Cl.[7] ..... E05B 45/06

[52] U.S. Cl. ..... 340/542; 70/439; 70/DIG. 49; 200/61.41

[58] Field of Search ..... 340/542, 568.2, 340/568.4; 200/61.41, 61.64, 61.67, 61.68; 70/439, DIG. 49

[56] References Cited

U.S. PATENT DOCUMENTS

| | | | |
|---|---|---|---|
| 3,569,950 | 3/1971 | Betz | 340/542 |
| 4,057,986 | 11/1977 | Zolke et al. | 70/233 |
| 4,556,872 | 12/1985 | Masoncup et al. | 340/542 |
| 4,663,611 | 5/1987 | Humphrey | 340/542 |
| 4,811,578 | 3/1989 | Masoncup et al. | 340/542 X |
| 4,959,635 | 9/1990 | Wilson | 340/568.2 |
| 5,168,258 | 12/1992 | Radke | 340/542 |
| 5,349,834 | 9/1994 | Davidge | 70/18 |
| 5,404,735 | 4/1995 | Hsieh | 70/38 A |
| 5,440,904 | 8/1995 | Su | 70/18 |
| 5,501,555 | 3/1996 | Muetschele et al. | 70/58 X |
| 5,531,082 | 7/1996 | Wolk et al. | 70/63 |
| 5,531,083 | 7/1996 | Franck, III et al. | 70/58 |
| 5,546,776 | 8/1996 | Sun et al. | 70/233 |
| 5,693,987 | 12/1997 | Krucoff | 307/10.2 |
| 5,727,405 | 3/1998 | Cromwell | 340/542 X |

FOREIGN PATENT DOCUMENTS

| | | |
|---|---|---|
| 2109109 | 5/1983 | United Kingdom . |

*Primary Examiner*—Thomas Mullen
*Attorney, Agent, or Firm*—Parsons & Goltry; Robert A. Parsons; Michael W. Goltry

[57] ABSTRACT

An alarmed cable lock that sounds an alarm upon an attempt to open the lock or remove the secured item while the alarm is armed. The invention includes a lock, a cable, a power source and an alarm. The lock includes a C-channel closed at one end, a switch, and a blocking pin. The cable is attached at one end to the lock. The free end of the cable terminates in a head that is formed to slide in the C-channel. The switch is exposed in the C-channel. When the lock is armed, the blocking pin extends into the C-channel to prevent the free end of the cable from sliding out of the open C-channel end. If an attempt is made to remove the end of the cable by sliding it out the C-channel, the head passes by the switch and sets off the alarm. The alarm/lock features are operated by remote control.

7 Claims, 3 Drawing Sheets

ALARMED CABLE LOCK

This invention relates generally to locks. More particularly this invention relates to a cable lock that sounds an alarm, before the lock is defeated, if an attempt is made to steal the secured item.

BACKGROUND

Cable locks are known in the art for securing moveable objects to stationary objects. Typically a cable is threaded through the object and secured around an immovable object, thus anchoring the item to the immovable object. Cable locks are also used to secure parts of moveable objects to each other so that they cannot be easily transported or opened. For example, bicycles and motorcycles are secured by threading a cable around the bike frame and at least one wheel and locking the cable ends together such that the cable prevents the bike wheels from rolling. In this manner the bike cannot be rolled away. The bike can be lifted and moved, however, if it is not secured to an immobile object.

Service trucks often carry expensive equipment that is too large to be locked in a tool box, but small enough to be carried away by a thief, loose in the bed of truck. Pick-up owners also carry equipment and toys loose in the bed of the trucks. U.S. Pat. No. 5,349,834 issued to Davidge illustrates a cable lock adhesively secured to the bed of a pick-up truck to secure equipment such as a chainsaw. U.S. Pat. 5,531,082 issued to Wolk discloses a portable security case which contains the objects to be secured. A cable integral with the case is locked around an immovable object such as a post.

Thieves can defeat cable locks by severing the cable, breaking the lock mechanism, or carting the moveable object away, as in the case of a bicycle. Alarmed cable locks have been developed to alert the owner if the lock has been defeated. For example, U.S. Pat. No. 4,057,986 issued to Zolke describes a portable, battery-powered cable lock that sounds an alarm if the cable is cut. The disadvantage of this type of alarmed lock is that the alarm sounds only after the lock has been defeated. Since the cable must have been severed for the alarm to sound, by the time the owner responds to the alarm the thief may have escaped with the previously secured item. It is desirable to have a loud alarm that sounds when a thief attempts to break the cable or lock, or when the object is lifted to be carried away.

Tamper resistant padlocks are described in the prior art. U.S. Pat. No. 5,404,735 issued to Hsieh discloses a battery-powered alarmed padlock. The device is a padlock with a large U-shaped shackle having a vibration switch that triggers the alarm if abnormal vibration is detected. This lock is unsuitable to be used in vehicles which vibrate when in motion, and is limited in the size and shape of articles it can secure because of the rigid shackle. A cable lock is desired that can secure large items and detect tampering, but is relatively insensitive to vibration so that it can be used in a vehicle.

Therefore, it is an object of this invention to provide an alarmed cable lock that sounds an alarm before the lock is defeated so that potential thieves are warned away. It is an object of this invention to provide an alarmed cable lock which can detect tampering, but is relatively insensitive to vibration so that it can be used in a vehicle without giving false alarms. It is a further object of this invention to provide an alarmed cable lock to secure loose equipment to, or within, a vehicle.

SUMMARY OF THE INVENTION

The present invention is an alarmed cable lock that sounds an alarm upon an attempt to open the lock or remove the secured item while the alarm is armed. The invention includes a lock, a cable, a power source and an alarm. The lock includes a C-channel closed at one end, a switch, and a blocking pin. The cable is attached at one end to the lock. The free end of the cable terminates in a head that is formed to slide in the C-channel. The switch is exposed in the C-channel. When the lock is armed, the blocking pin extends into the C-channel to prevent the free end of the cable from sliding out of the open C-channel end. If an attempt is made to remove the end of the cable by sliding it out the C-channel, the head passes by the switch and sets off the alarm. The alarm/lock features are operated by remote control.

DESCRIPTION OF THE PREFERRED EMBODIMENTS

Figure 1:
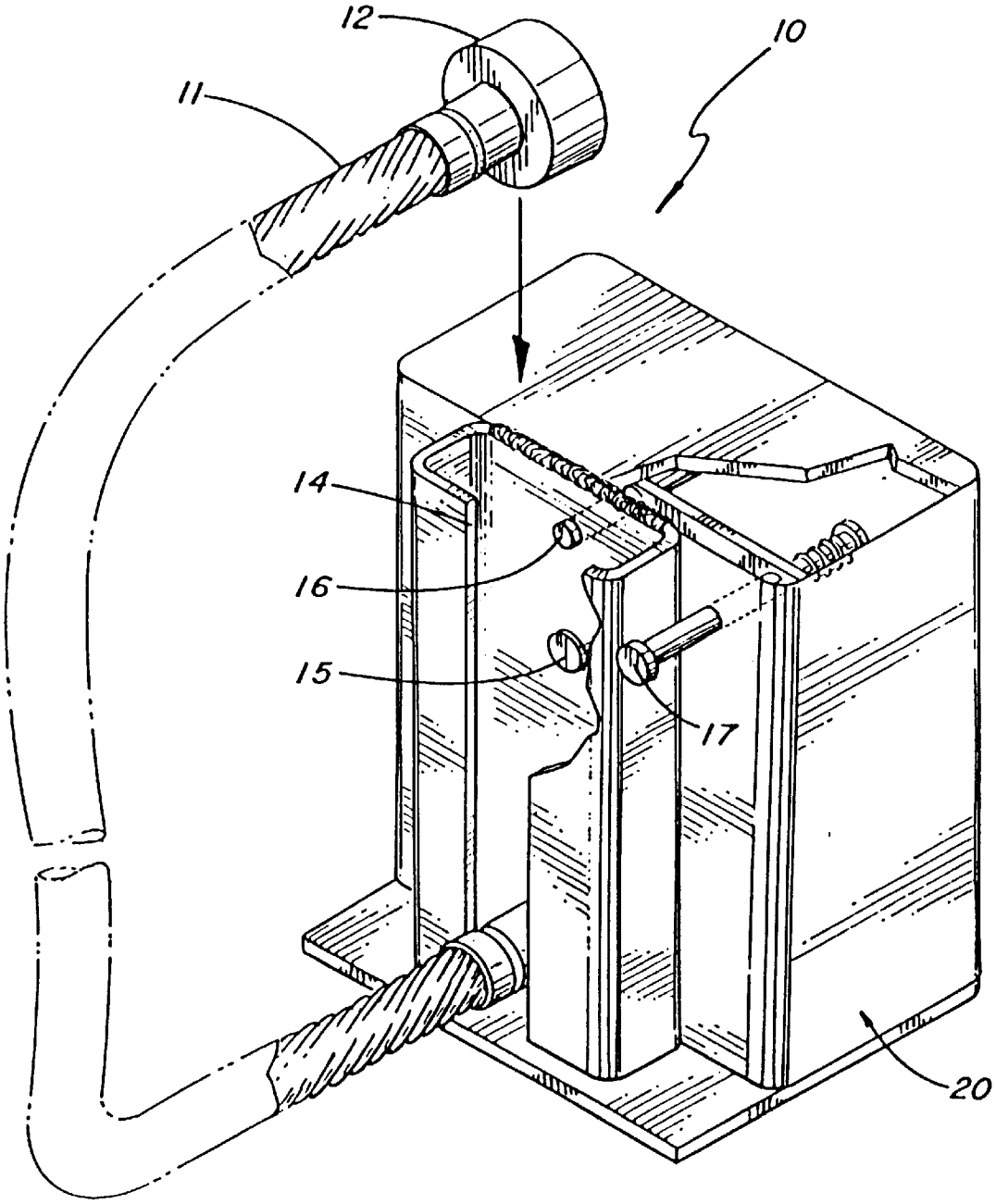
FIG. 1 is an illustration of the alarmed cable lock.

FIG. 1 illustrates the alarmed cable lock, indicted generally as 10. The lock includes a cable 11 attached at one end to the lock housing 20. Alternatively, the cable 11 may be permanently attached at one end to another sturdy base, such as a vehicle body. The free end of the cable 11 terminates in a head 12. The lock 10 includes a channel 14 to receive the head 12, a switch 15, a blocking pin 16, and a pin release 17.

Figure 2:
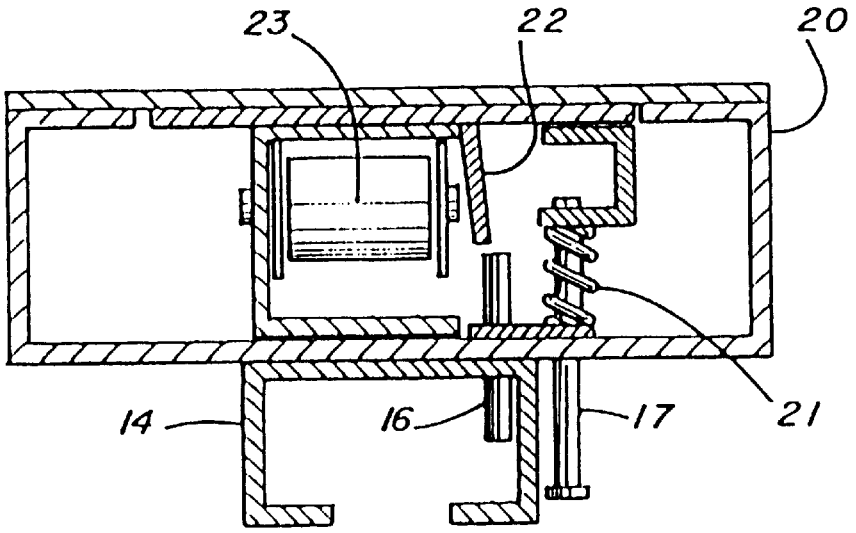
FIG. 2 is a cut-away top view of the lock in latched mode.
Figure 3:
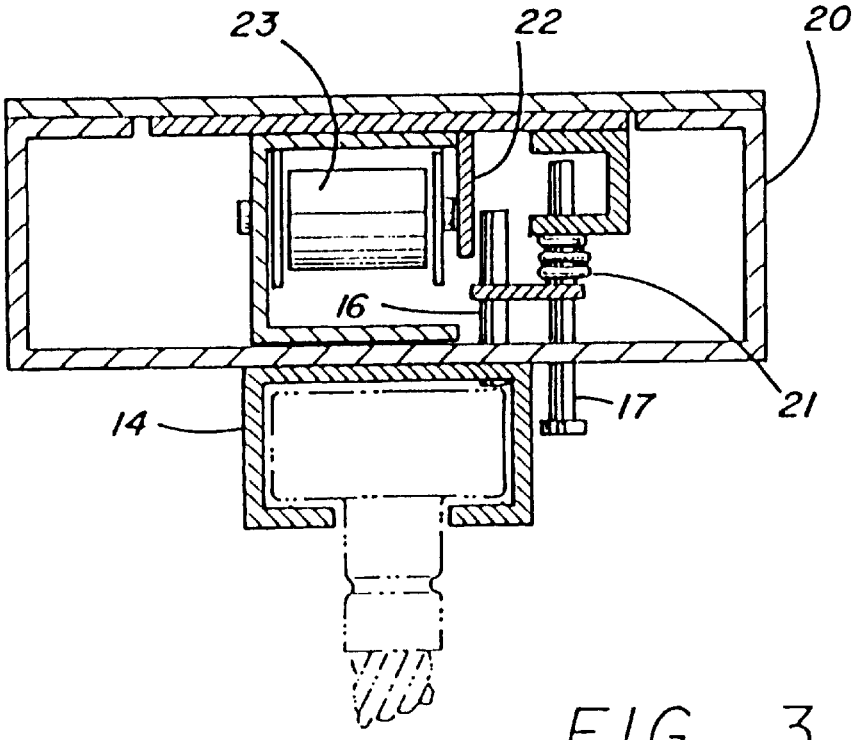
FIG. 3 is a cut-away top view of the lock in release mode.

The blocking pin 16 and pin release 17 work in cooperation with a solenoid to control whether the blocking pin is in latch mode or release mode. FIG. 2 shows the device in latch mode wherein the blocking pin is extended into the channel, thereby preventing the head from being removed from the channel. Blocking pin 16 extends into the channel 14 and through the lock housing 20. Pin release 17 is connected to the blocking pin 16 and is spring biased in a normally extended position with spring 21. While no current is running through solenoid 23, arm 22 obstructs the retraction of blocking pin 16 from channel 14. FIG. 3 shows the device in release mode. When current is running through the solenoid 23, arm 22 is attracted to the solenoid 23, thereby pulling it out of the path of the blocking pin 16. Pin release 17 is depressed and blocking pin 16 is retracted from the channel, leaving an open path for the cable head to be moved into or out of the channel.

Figure 4:
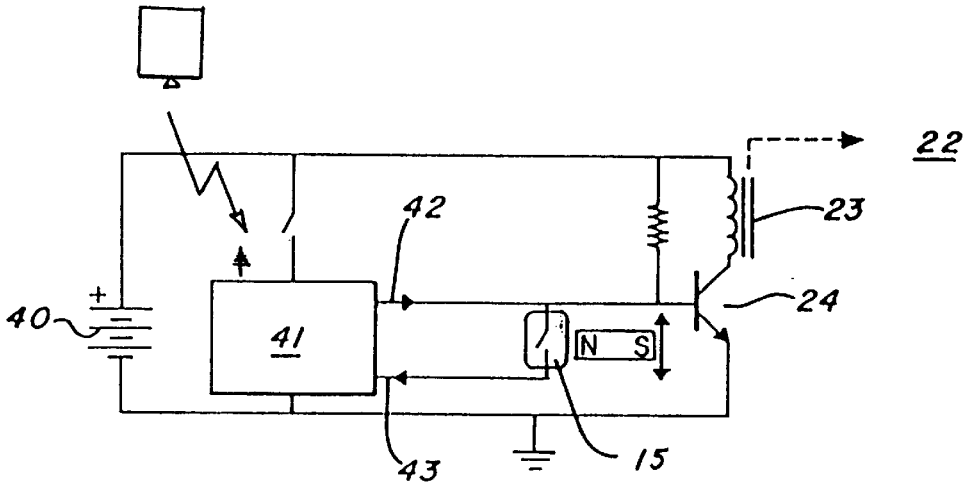
FIG. 4 is a schematic diagram of the circuit of the preferred embodiment.

FIG. 4 illustrates the circuitry of the preferred embodiment of the invention. The security system 41 is connected to the power source 40, preferably a vehicle battery. The security system 41 has at least one output terminal 42 and one input terminal 43. To retract the blocking pin 16 from the channel 14, a high is output. The high turns on the transistor 24 and current flows through the solenoid 23. The arm 22 is attracted toward the solenoid 23, which allows the pin release 17 to be manually depressed, retracting the blocking pin 16 and opening the channel 14. To prevent the pin release 17 from being depressed, thereby keeping the channel blocked and the head in the channel, a low is output. No current reaches the solenoid 23 and the arm 22 stays in a position to prevent the blocking pin 16 from retracting. To place the head 12 in the channel 14, a high is output to put the lock in release mode. The pin release 17 is depressed and the head is inserted. Preferably the low is output automatically after a given delay to return the lock to latch mode.

The switch 15 works in cooperation with the head 12 to detect tampering. If the head is moved past the switch 15, a low is sent to the input 43 and the alarm sounds. If, for example, a thief grabs the cable and tries to pull the head from the channel to free the object, the alarm sounds and the thief is deterred by the sounding alarm. The switch 15 is interposed between the closed end of the channel and the blocking pin, so that the head has some room for movement in the channel before causing the alarm to sound. This allows for normal lock vibration and helps prevent false alarms. Preferably the switch is magnetic and is triggered with a magnet located in the head 12. Alternately, the switch may be electrical, optical, or physical, with a corresponding cooperative head to trigger each type of switch. Cooperative heads are made of, for example, a conductive metal, opaque material, or durable material, respectively.

Figure 5:
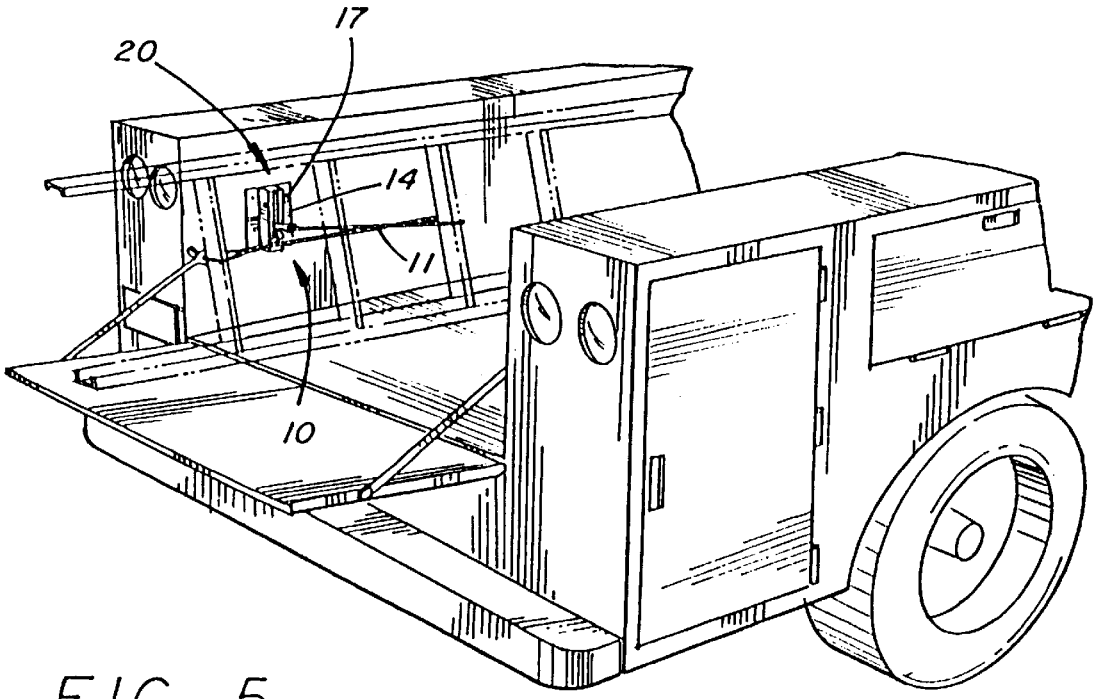
FIG. 5 illustrates the alarmed cable lock installed in a service truck.

In the preferred embodiment, the lock housing 20 is permanently attached to a vehicle, preferably by welds or bolts, and most preferably in the bed of a service truck, as shown in FIG. 5. However, the lock housing 20 can be secured to any heavy or immovable object which functions as an anchor to the locked object. The channel is preferably installed in a vertical position, with the closed end of the channel at the bottom. In this configuration, the head tends to sit in the closed end of the channel with the aid of gravity until manually raised along the channel to detach the cable from the lock, thus helping to prevent false alarms.

The system is operated by remote control. Remote controlled vehicle security systems are available commercially and may be installed during the vehicle manufacture or as an after-market accessory. To secure an object, the cable 11 is threaded through the item to be secured. The security system is set to release mode by remote control. Preferably, the security system is set to release mode simultaneously with arming the system. In a typical example, the remote control button is depressed, a chirp sounds to alert the user the system is armed and the release period has started. The pin release is depressed during the release period and the head is inserted into the channel and is left to rest below the switch. After a predetermined delay determined by the security system, the system reverts to latch mode and the pin release can no longer be depressed, thereby preventing the head from sliding out of the channel. While the security system is armed, if the head is moved past the switch, the alarm sounds.

I claim:

1. An alarmed cable lock comprising:

a) a channel closed at one end;

b) a cable having at least one free end, the free end including a terminus that cooperates with the channel to secure the free end to the channel;

c) a blocking pin capable of preventing the free end of the cable from being removed from the open end of the channel;

d) a switch exposed to the channel, interposed between the closed end of the channel and the blocking pin; and e) a security system in electrical connection with the switch such that if the terminus of the cable is passed over the switch, the security system emits an audible sound.

2. An alarmed cable lock according to claim 1, wherein the switch is a magnetic switch and the terminus is magnetic.

3. An alarmed cable lock according to claim 1 further comprising a manual release for the blocking pin.

4. An alarmed cable lock according to claim 1 wherein the security system is operated by remote control.

5. An alarmed cable lock comprising:

a) a lock housing attached to a vehicle having a battery and a security system;

b) a channel attached to the lock housing, the channel closed at one end and open at the other;

c) a cable having two ends, a free end including a terminus formed to cooperate with the channel and the other end secured to the vehicle;

d) a solenoid in connection with the battery, which operates an arm to allow retraction of a blocking pin normally extended into the channel;

e) a release pin connected to the blocking pin;

f) a magnetic switch exposed to the channel, interposed between the closed end of the channel and the blocking pin;

wherein the battery supplies current to the solenoid, the arm is moved to a position to allow the blocking pin to be retracted from the channel by depressing the release pin and wherein if the free end of the cable is passed over the magnetic switch, an audible sound is emitted from the security system.

6. An alarmed cable lock according to claim 5 wherein the security system is operated by remote control.

7. An alarmed cable lock comprising:

a) a lock housing attached to a vehicle having a battery;

b) a channel included in the lock housing, the channel closed at one end and open at the other;

c) a cable having two ends, a free end including a terminus formed to cooperate with the channel and the other end secured to the vehicle;

d) a solenoid in connection with the batter; which operates an arm to allow retraction of a blocking pin normally extended into the channel;

e) a release pin connected to the blocking pin; and wherein the battery supplies current to the solenoid, and the arm is moved to a position to allow the blocking pin to be retracted from the channel by depressing the release pin.

* * * * *